United States Patent [19]

Peters

[11] Patent Number: 4,857,013

[45] Date of Patent: Aug. 15, 1989

[54] ELECTRIC ATTACHMENT PLUG

[76] Inventor: Glen R. Peters, 509 - 825 Granville St., Vancouver, B.C. V6Z 1K9, Canada

[21] Appl. No.: 182,463

[22] Filed: Apr. 18, 1988

[30] Foreign Application Priority Data

Dec. 30, 1985 [CA] Canada ..... 498727

[51] Int. Cl.[4] ..... H01R 19/04

[52] U.S. Cl. ..... 439/484; 439/694

[58] Field of Search ..... 439/692–697, 439/597–601, 483, 484

[56] References Cited

U.S. PATENT DOCUMENTS

| | | | |
|---|---|---|---|
| 1,714,763 | 5/1929 | Boyson | 439/484 |
| 2,030,115 | 2/1936 | Muldoon | 439/484 |
| 2,487,509 | 11/1949 | Baker | 439/597 |
| 2,497,568 | 2/1950 | Thacker | 439/597 |

FOREIGN PATENT DOCUMENTS

| | | | |
|---|---|---|---|
| 239453 | 4/1924 | Canada . | |
| 660044 | 3/1963 | Canada . | |
| 852356 | 9/1970 | Canada . | |
| 1135541 | 8/1962 | Fed. Rep. of Germany | 439/692 |
| 0893081 | 5/1944 | France | 439/483 |
| 0066471 | 4/1969 | German Democratic Rep. | 439/692 |

*Primary Examiner*—Gary F. Paumen

[57] ABSTRACT

In the attachment of an appliance's electrical supply cord to an ordinary electrical outlet on a wall, it is common to have a plug encasing the cord such that the cord adjacent to the plug will be parallel to the wall when the plug is inserted into the outlet, permitting furniture or other objects in front of the outlet to be set closer to the wall. In this invention, the protrusion of the plug from the outlet is reduced to the width of the electrical cord itself. The invention will be of great value in allowing the cord to lie substantially flat against a wall even at its juncture with the plug and in allowing furniture or other objects to be set approximately a mere width of the cord away from the electrical outlet surface. A pivoting tab whose end can be swung away from the main body of the plug to facilitate grasping for disengaging the plug from the outlet is provided.

14 Claims, 2 Drawing Sheets

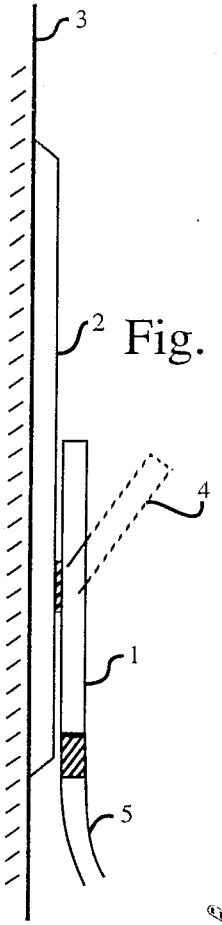
Fig. 1
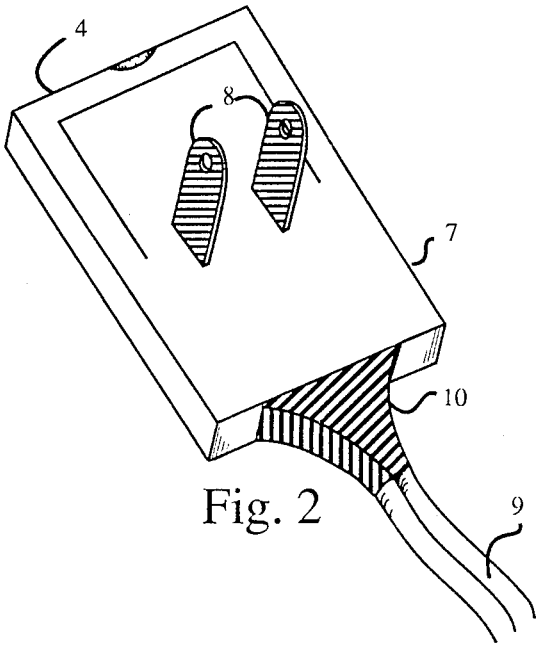
Fig. 2
Fig.3
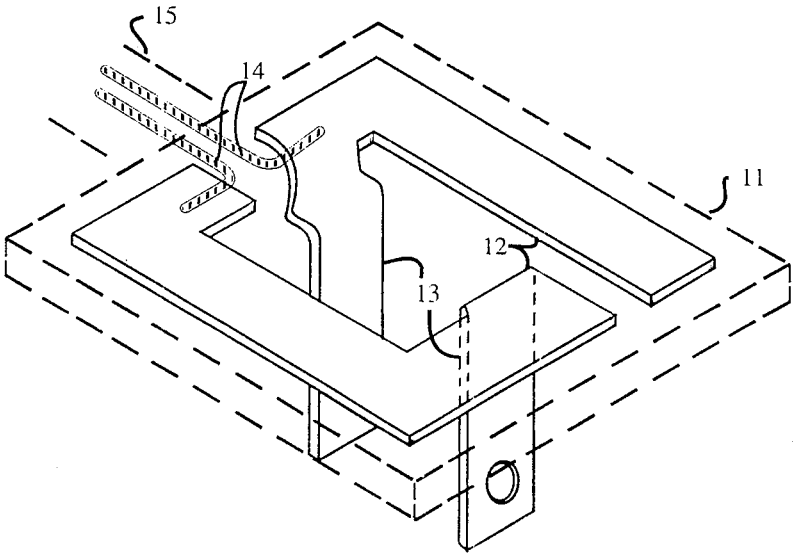

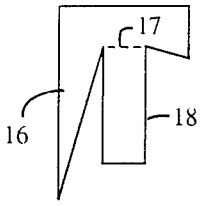
Fig. 4
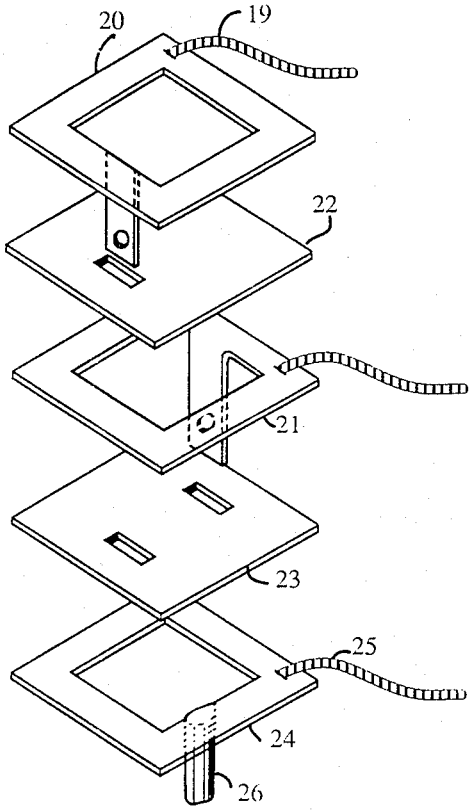
Fig. 5
Fig. 6
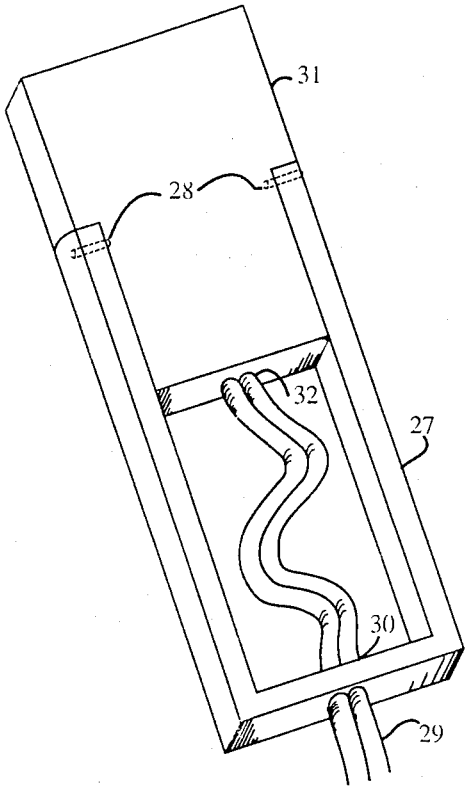

ELECTRIC ATTACHMENT PLUG

BACKGROUND OF THE INVENTION

FIELD OF THE INVENTION

This invention relates to the plugging in of electrical appliance cords into ordinary building electrical outlets. The device is a flat plug, which allows the cord to lie flat against the wall or floor in which the outlet is situated. The cord will lie flat against the electrical outlet even at the cord's juncture with the plug. The flat plug allows furniture or other objects to be set a mere width of the cord away from the wall. If the outlet is situated in the floor, the flat plug's lack of protrusion is also an advantage, as it minimizes obstruction to the placement or movement of objects. The invention is a unique assemblage of known components and methods. The invention is comprised of plastic or like insulating material and commonly used electrical cords and prongs. The parts are brought together in a specific form to comprise a new device which is this invention.

Electricity is commonly supplied to an electrical appliance through a length of plastic cord enclosing and mutually insulating two parallel wire conductors. The conductors are appropriately secured at one end to the appliance and at the other end to an attachment plug. The attachment plug consists of thicker plstic or like insulating material and terminates with two prongs that are made to mate with two rceptacles in an electrical supply outlet. The outlet is typically installed in a wall and is substantially flush with the surface of the wall.

Conventional electrical attachment plugs have undesirable characteristics. In order to physically enclose the end of the cord and the prongs, and in order to provide an area for the user to grip the plug, conventional plugs have had a size and structure that results in a considerable protrusion from the outlet once the plug is inserted. This protrusion makes the plug susceptible to unintentional disengagements by a moving object and also limits the placement of furniture and other objects in front of the outlet to some distance away from the wall. The protrusion has previously been reduced by having the cord enter the plug at a right angle to the prongs. making for an approximately parallel position of the cord to the wall at the juncture of cord and plug. A variety of such devices have been used or proposed, as in U.S. Pat. Nos. 1,950,036; 1,984,181; 2,425,679; 2,542,609; 2,869,102; 3,137,536; 3,335,395; 3,718,890; 3,747,049; 3,784,961; 3,787,798; 3,803,530; 3,829,819; 3,936,129; 3,950,069; 4,006,958; 4,035,051; 4,284,317. In U.S. Pat. No. 3,474,376 it was disclosed that the protrusion could be reduced still further by having prongs that pivoted within the plug, allowing the plug to swing up and protrude for gripping when being inserted or disengaged, while folding down closer to the wall when plugged into the outlet. A complimentary pivoting of the cord instead is found in U.S. Pat. No. 3,032,740. In none of these earlier inventions is the plug protrusion reducd to the width of the cord as in the within invention. Previous attempts simply to miniaturize the plug resulted in the user being encouraged to pull on the cord rather than the plug when disengaging, in a manner that was deleterious to the attachment of the cord's conductors to the prongs within the plug. In the within invention, the protrusion of the plug is reduced to the greatest useful degree, in a structure that avoids the problem of a user pulling on the cord itself.

SUMMARY OF THE INVENTION

DESCRIPTION OF THE DRAWINGS

FIG. 1 is a drawing of an elevation view of the device inserted into a wall electrical outlet with a pulling tab shown in broken lines in the deployed position.

FIG. 2 is a drawing of a perspective view of the device.

FIG. 3 is an isometric section of the device showing one form of anchored conductor prongs within the plug.

FIG. 4 is a drawing showing another form of anchored conductor prong before the prong is bent along the broken line to stand out at ninety degrees.

FIG. 5 is an isometric section of another form of internal plates and anchors for the conductor prongs.

FIG. 6 is drawing of a back perspective view of an embodiment of the device showing an alternative pulling tab.

GENERAL DESCRIPTION

An object of the present invention is to provide an electrical cord attachment plug that is of minimal protrusion when inserted into an electrical outlet. A further object of the invention is to provide such a plug that allows the cord to lie flat against the wall or other structure along whose surface the electrical outlet is substantially flush, even at the juncture of the cord and the plug. Yet another object of the invention is to provide a means of decoupling the plug from the outlet without deleterious and possibly dangerous effect on the internal connections of the plug.

To this end, the invention provides a molded casing of plastic or like insulating material of a thickness approximately equal to the thickness of the electrical cord. The plastic is of sufficient stiffness to support the anchored prongs for insertion into the electrical outlet. The wire conductors of the cord are soldered or otherwise affixed to the base of the prong anchors within the plug. The prongs could be identical for fitting old fashioned electrical outlets, or one could be wider than the other in order to fit a polarized electrical outlet receptacle.

The cord enters the edge of the plug, with the edges of the plug and the length of the cord being in the same plane.

Another feature is a pulling tab, which pivots away from the flat plane of the plug for ease of grasping by the user. The tab may be mechanically hinged, or may consist simply of pinched or otherwise flexible plastic at its hinging points on the plug.

An optional feature is the addition of a strain relief of flexible plastic at the juncture of plug and cord. Another optional feature would be to have fiber reinforcement in the plug or the cord or in both, particularly at their juncture.

Another optional form would be a plug as above, with dual sets of prongs for complete coverage of a typical dual receptacle electrical outlet.

A final optional form would be a plug as above, with multiple cords for multidirectional or multiple power supply availability.

DETAILED DESCRIPTION

Referring to FIG. 1, the plug 1 is shown mounted in a typical electrical outlet 2 substantially flush with the wall 3. An optional pulling tab 4 is shown in broken lines. The cord 5 runs parallel to and approximately flush with the wall even at the cord's juncture with the plug 1.

Referring to FIG. 2, the pulling tab 6 fits flush with the rest of the plug 7 when not deployed for extracting the plug from the electrical outlet. The prongs 8 are shown in a configuration permitting an immediate vertical position of the cord 9 when the plug 7 is mounted in a typical vertically mounted dual electrical outlet. Optionally, the prongs 8 and/or the cord 9 could be constructed in plug 7 at an orientation so as to permit the cord to run horizontal along a wall from such an outlet, or at any desired angle. The optional strain relief 10 is shown at the sides of the juncture of the plug 7 and cord 9.

Referring to FIG. 3, a section of the plug 11 reveals a form of conductor anchor 12 and conductor prongs 13, soldered to the conducting wires 14 within the cord 15.

Referring to FIG. 4, another shape of anchored conductor prong plate 16 is shown, before it is bent at ninety degrees along broken line 15 to form the conductor prong 18.

Referring to FIG. 5, another arrangement of internal conductor and insulator plates is shown. One wire conductor 19 from the cord is affixed to conductor plate 20, which is seaparate from the other conductor plate 21 by an insulator plate 22. The insulating plate 22 has a slot through which the prong of conductor plate 20 passes. A second insulator plate 23 with two slots, through which the two prongs of conductor plates 20 and 21 pass, may be used in conjunction with a third conductor plate 24 affixed to a grounding wire 25 and a grounding prong 26.

Referring to FIG. 6, an alternative pulling tab 27 is shown with hinges 28. The cord 29 is affixed to the tab 27 at 30 and to the plug 31 at 32, with some slack in the cord in between the two points of affixation, to allow the tab 27 to be rotated approximately ninety degrees from the back of the plug 31. This arrangement is very advantageous because it guards against strain on the affixation of the cord to the plug in the case where the user attempts to extract the plug by pulling on the cord, and in fact the placement of the tab 27 makes it convenient for the user to grasp it in the course of attempting to extract the plug by pulling on the cord.

The present invention may be embodied in other specific forms without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims ar therefore intended to be embraced therein.

I claim:

1. A device for the attachment of an electrical appliance cord to an electrical outlet comprising a flat one-piece insulating plug of virtually the same thickness as the electrical cord, in which plug are embedded the flat bases of at least two electrical contact prongs, said prongs extending at right angles to said plug, said bases being affixed within the plug to conductor wires within the electrical cord and on which plug there is a pivoting tab whose end can be swung away from the main body of the plug to facilitate grasping for disengaging the plug from the outlet.

2. The device as claimed in claim 1 above, in which the tab pivots about a geometrical axis that runs through the center of the plug.

3. The device as claimed in claim 1 above, in which the tab pivots about a geometrical axis that runs through the center of the plug when the plug is disengaged from the outlet.

4. The device as claimed in claim 1 above, in which the tab forms an outer border of the end of the plug opposite the cord end of the plug.

5. The device as claimed in claim 1 above, in which the tab is mechanicaly hinged at its point of attachment to the rest of the plug.

6. The device as claimed n claim 1 above, in which the tab is flexible, allowing it to bend away from the rest of the plug.

7. The device as claimed in claim 1 above, in which the cord is affixed to the tab.

8. The device as claimed in claim 1 above, in which there is a strain relief attached to the cord and the plug at their juncture.

9. The device as claimed in claim 1 above, in which there is fiber reinforcement within the juncture of the cord and plug.

10. The device as claimed in claim 1 above, in which the prongs and cord are arranged such that the cord runs vertically along a wall upon insertion into a typical electrical outlet having vertical side-by-side contact slots.

11. The device as claimed in claim 1 above, in which the prongs and cord are arranged such that the cord runs at a non-vertical angle along a wall upon insertion into a typical electrical outlet having vertical side-by-side contact slots.

12. The device as claimed in claim 1 above, in which the conductor prongs are formed as part of, but bent ninety degrees to, said bases within the plug.

13. The device as claimed in claim 1 above, in which there are two conductor prongs.

14. The device as claimed in claim 1 above, in which the prongs are shaped differently from each other in order to fit a typical polarized electrical outlet.

* * * * *